US009681217B2

(12) United States Patent
Mihelich et al.

(10) Patent No.: US 9,681,217 B2
(45) **Date of Patent: *Jun. 13, 2017**

(54) ELECTRONIC DEVICE INCLUDING ACOUSTICALLY ISOLATED SERPENTINE PORT AND RELATED METHODS

(71) Applicant: Apple Inc., Cupertino, CA (US)

(72) Inventors: Ryan J. Mihelich, Cupertino, CA (US); Inna Lobel, Cupertino, CA (US)

(73) Assignee: APPLE INC., Cupertino, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/847,584

(22) Filed: Sep. 8, 2015

(65) Prior Publication Data

US 2017/0070811 A1 Mar. 9, 2017

(51) Int. Cl.
*H04R 1/02* (2006.01)
*H04R 1/28* (2006.01)

(52) U.S. Cl.
CPC ..... *H04R 1/2857* (2013.01); *H04R 1/2834* (2013.01); *H04R 2201/029* (2013.01); *H04R 2400/03* (2013.01); *H04R 2499/15* (2013.01)

(58) Field of Classification Search
CPC ..... H04R 1/2857; H04R 1/2834; H04R 2201/029; H04R 2400/03; H04R 2499/15
USPC ..... 381/87, 333, 386, 332, 334
See application file for complete search history.

(56) References Cited

U.S. PATENT DOCUMENTS

| | | | | |
|---|---|---|---|---|
| 8,169,402 | B2 | 5/2012 | Shahoian et al. | |
| 2005/0233781 | A1* | 10/2005 | Erixon | H04M 1/035 455/575.1 |
| 2007/0081691 | A1* | 4/2007 | Park | H04M 1/03 381/386 |
| 2014/0002346 | A1* | 1/2014 | Weddle | G06F 3/016 345/156 |
| 2014/0197936 | A1 | 7/2014 | Biggs et al. | |
| 2015/0109223 | A1 | 4/2015 | Kessler et al. | |
| 2015/0116205 | A1 | 4/2015 | Westerman et al. | |

(Continued)

FOREIGN PATENT DOCUMENTS

| | | | |
|---|---|---|---|
| WO | 2013169299 | A1 | 11/2013 |
| WO | 2013169303 | A1 | 11/2013 |
| WO | 2013169305 | A1 | 11/2013 |

(Continued)

OTHER PUBLICATIONS

Mihelich, Ryan J., U.S. Appl. No. 14/847,505, filed Sep. 8, 2015.

(Continued)

*Primary Examiner* — Vivian Chin
*Assistant Examiner* — Friedrich W Fahnert
(74) *Attorney, Agent, or Firm* — Allen, Dyer, Doppelt & Gilchrist, P.A.

(57) ABSTRACT

An electronic device may include a housing having an audio output port therein, a display carried by the housing, and a baffle enclosure carried within the housing. The electronic device may also include an audio output transducer carried by the baffle enclosure and acoustically coupled to the audio output port, and internal partitions carried by the baffle enclosure to define a serpentine tuning port therein acoustically coupled between the audio output transducer and the display, and acoustically isolated from the audio output port.

20 Claims, 9 Drawing Sheets

(56) References Cited

U.S. PATENT DOCUMENTS

| | | | | |
|---|---|---|---|---|
| 2015/0130730 | A1 | 5/2015 | Harley et al. | |
| 2016/0316050 | A1* | 10/2016 | Lombardi ..... | H04M 1/7253 |

FOREIGN PATENT DOCUMENTS

| | | | |
|---|---|---|---|
| WO | 2013170099 | A1 | 11/2013 |
| WO | 2013188307 | A2 | 12/2013 |
| WO | 2014018111 | A1 | 1/2014 |
| WO | 2015020663 | A1 | 2/2015 |

OTHER PUBLICATIONS

Mihelich, Ryan J., U.S. Appl. No. 14/847,698, filed Sep. 8, 2015.
Mihelich, Ryan J., U.S. Appl. No. 14/847,787, filed Sep. 8, 2015.
Product Specification Sheet: GEEPLUS, VIBRO1 Vibration Actuator, 2 pages, www.geeplus.biz, downloaded on Jul. 15, 2015.

* cited by examiner

ELECTRONIC DEVICE INCLUDING ACOUSTICALLY ISOLATED SERPENTINE PORT AND RELATED METHODS

TECHNICAL FIELD

The present disclosure relates to the field of electronics, and, more particularly, to the field of haptics.

BACKGROUND

Haptic technology is becoming a more popular way of conveying information to a user. Haptic technology, which may simply be referred to as haptics, is a tactile feedback based technology that stimulates a user's sense of touch by imparting relative amounts of force to the user.

A haptic device or haptic actuator is an example of a device that provides the tactile feedback to the user. In particular, the haptic device or actuator may apply relative amounts of force to a user through actuation of a mass that is part of the haptic device. Through various forms of tactile feedback, for example, generated relatively long and short bursts of force or vibrations, information may be conveyed to the user.

SUMMARY

An electronic device may include a housing having an audio output port therein, a display carried by the housing, and a baffle enclosure carried within the housing. The electronic device may also include an audio output transducer carried by the baffle enclosure and acoustically coupled to the audio output port, and a plurality of internal partitions carried by the baffle enclosure to define a serpentine tuning port therein acoustically coupled between the audio output transducer and the display, and acoustically isolated from the audio output port. Accordingly, haptic feedback may be provided via the display.

The audio output transducer may be directed to an underside of the display, for example. The baffle enclosure may have a tuning port opening therein and the tuning port opening may be directed to an underside of the display, for example.

The audio output transducer may be laterally adjacent the tuning port opening. The electronic device may further include an external partition carried within the housing and outside the baffle enclosure between the audio output transducer and the tuning port opening.

The baffle enclosure may include opposing first and second sidewalls. The plurality of internal partitions may extend inwardly from the opposing first and second sidewalls, for example. The plurality of internal partitions may extend inwardly from the opposing first and second sidewalls in an alternating fashion, for example. The plurality of internal partitions may be parallel.

The audio output transducer may be laterally adjacent the serpentine tuning port, for example. The display may be a touch-screen display.

Another device aspect is directed to an electronic device that may include a housing having an audio output port therein, wireless communications circuitry carried by the housing, and a display carried by the housing. The electronic device may also include a baffle enclosure carried within the housing, an audio output transducer carried by the baffle enclosure and acoustically coupled to the audio output port, and a plurality of internal partitions carried by the baffle enclosure to define a serpentine tuning port therein acoustically coupled between the audio output transducer and the display, and acoustically isolated from the audio output port. A controller may be coupled to the wireless communications circuitry, the display, and the audio output transducer. The controller may be capable of performing at least one wireless communications function, and selectively operating the audio output transducer to provide haptic feedback via the display.

A method aspect is directed to a method of making an electronic device that includes a housing having an audio output port therein, and a display carried by the housing. The method may include mounting an audio output transducer on a baffle enclosure and mounting a plurality of internal partitions to be carried by the baffle enclosure to define a serpentine tuning port therein. The method may also include mounting the baffle enclosure within the housing so that the audio output transducer is acoustically coupled to the audio output put, and so that the serpentine tuning port is between the audio output transducer and the display and acoustically isolated from the audio output port.

DETAILED DESCRIPTION

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout and prime and multiple prime notation is used to refer to like elements in different embodiments.

Figure 1:
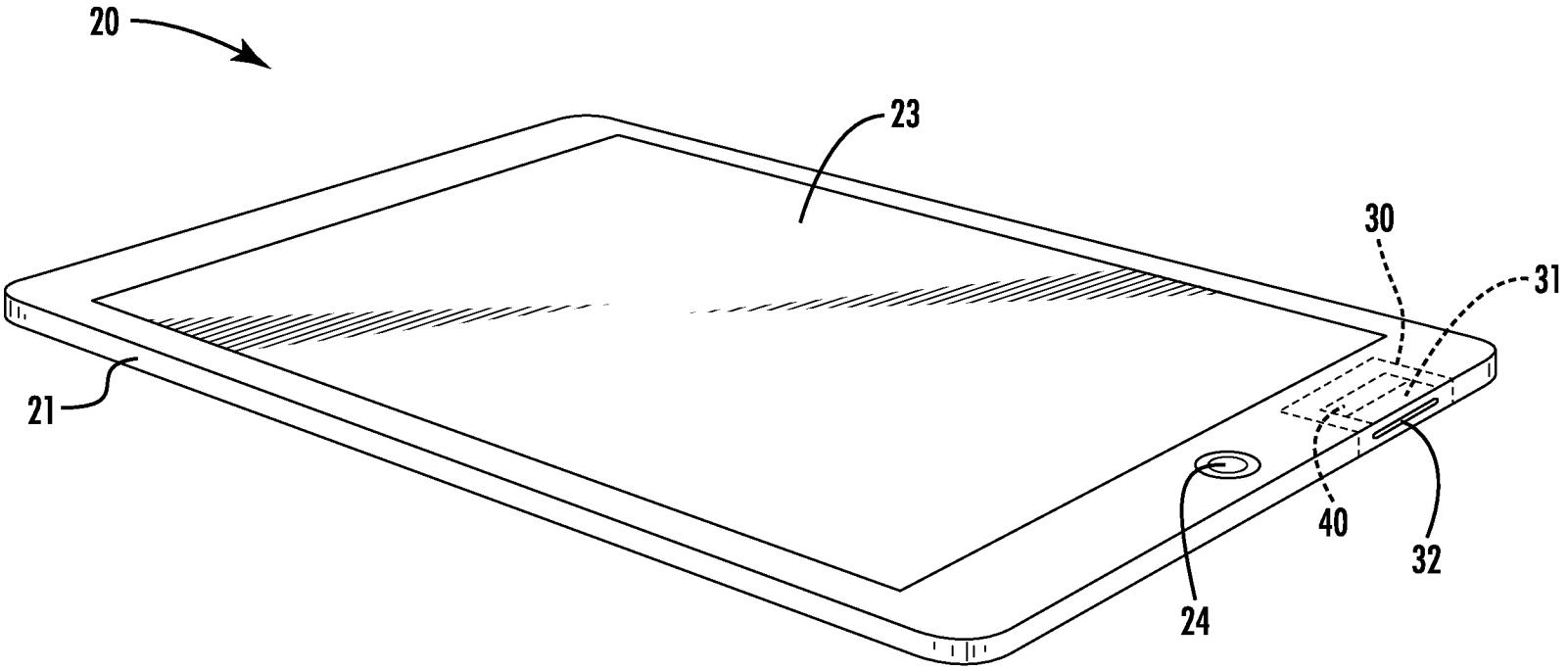
FIG. 1 a perspective view of an electronic device according to an embodiment.
Figure 2:
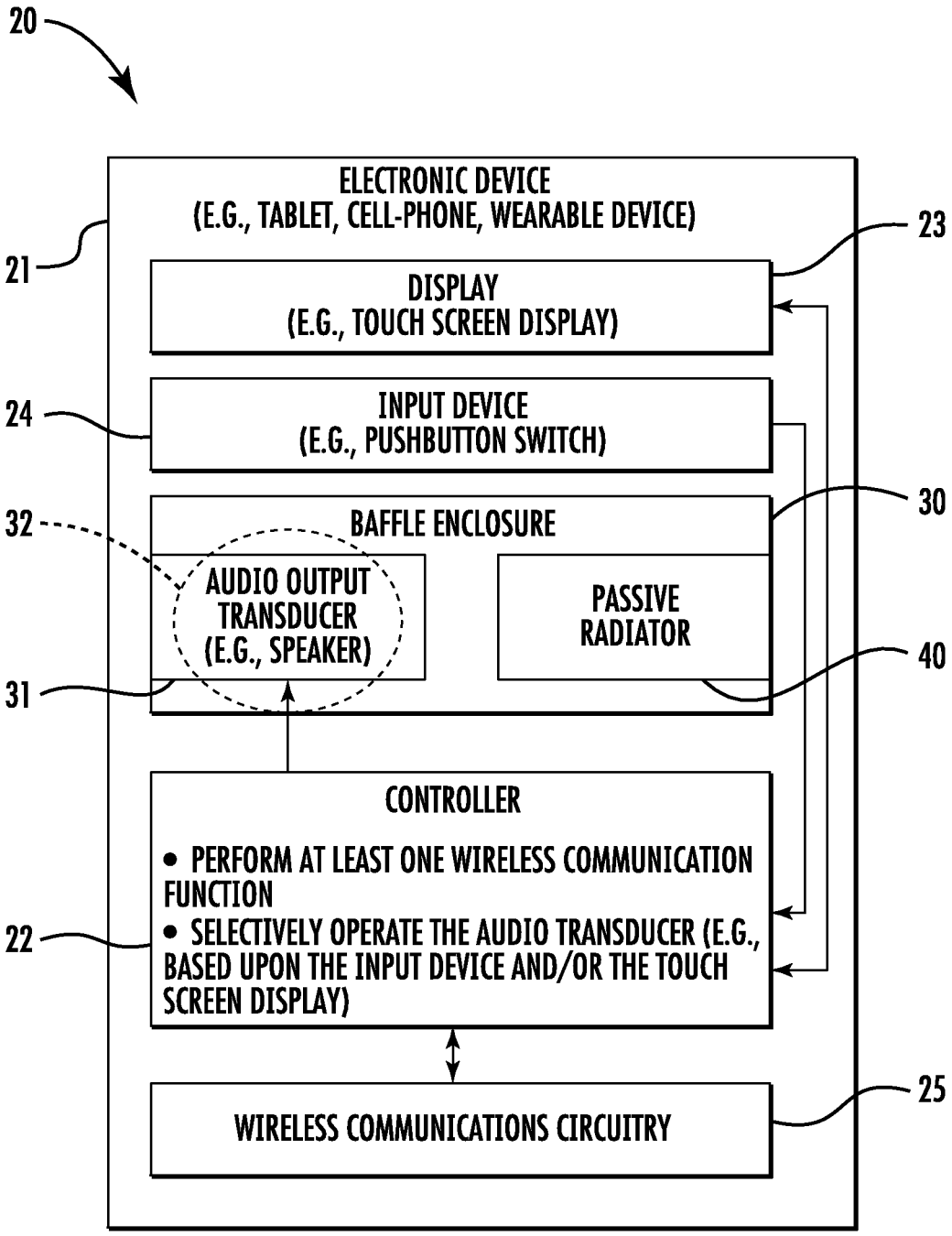
FIG. 2 is a schematic block diagram of the electronic device of FIG. 1.

Referring initially to FIGS. 1 and 2, an electronic device 20 illustratively includes a device housing 21 and a controller 22 carried by the device housing. The electronic device 20 is illustratively a mobile wireless communications device, for example, tablet computer. The electronic device 20 may be another type of electronic device, for example, a cellular telephone, a wearable device, a laptop computer, etc.

Wireless communications circuitry 25 (e.g. cellular, WLAN Bluetooth, etc.) is also carried within the device housing 21 and coupled to the controller 22. The wireless communications circuitry 25 cooperates with the controller 22 to perform at least one wireless communications function, for example, for voice and/or data. In some embodiments, the electronic device 20 may not include wireless communications circuitry 25.

A display 23 is also carried by the device housing 21 and is coupled to the controller 22. The display 23 may be a touch screen display, for example, or may be another type of display, as will be appreciated by those skilled in the art. The display 23 may include a glass layer, for example, a relatively thin protective glass, may be over the display layers, as will be appreciated by those skilled in the art.

A finger-operated user input device, illustratively in the form of a pushbutton switch 24 is also carried by the device housing 21 and is coupled to the controller 22. The pushbutton switch 24 may cooperate with the controller 22 to perform a device function in response to operation thereof. For example, a device function may include a powering on or off of the electronic device 20, initiating communication via the wireless communications circuitry 25, and/or performing a menu function. Of course, there may be additional user input devices, for example, the display 23 when it is in the form of a touch screen display, that perform other and/or additional device functions.

Figure 3:
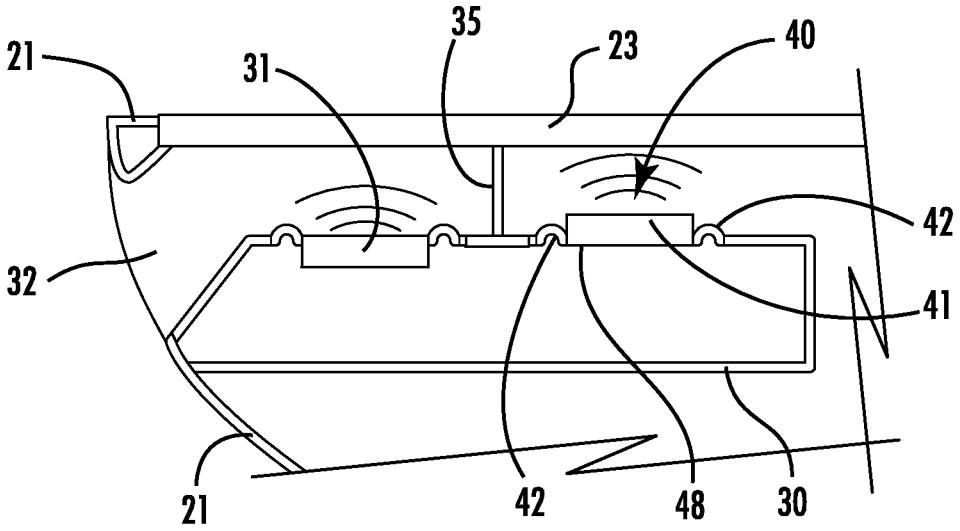
FIG. 3 is schematic cross-sectional view of a portion of the electronic device of FIG. 2.

Referring now additionally to FIG. 3, the electronic device 20 illustratively includes a baffle enclosure 30 carried by the housing. The baffle enclosure 30 carries an audio output transducer, in the form of a miniature speaker 31. The speaker 31 is coupled to the controller 22 and cooperates therewith to output audio, for example, music, device status sounds, notifications, etc. Of course, the speaker 31 may output other types of audio.

The baffle enclosure 30, and more particularly, the speaker 31 is positioned or aligned so that it is acoustically coupled to an audio output port 32 in the bottom of the housing. The audio output port 32 may be positioned elsewhere in the device housing 21. The speaker 31 is also directed to an underside of the display 23 for providing haptic feedback through the display, as will be explained in further detail below.

A passive radiator 40 is also carried by the baffle enclosure 30 laterally adjacent the speaker 31. In other embodiments, the passive radiator 40 and speaker 31 may not be laterally adjacent. The passive radiator 40 is acoustically coupled to the display 23, and more particularly, between the speaker 31 and the display, and directed to the underside of the display to also provide the haptic feedback through the display. The passive radiator 40 is also acoustically isolated from the audio output port 32, as will be explained in further detail below. In some embodiments, the passive radiator 40 may include non-metallic materials, for example, ceramic or porcelain. The passive radiator 40 may be formed of other and/or additional materials.

The baffle enclosure 30 has a radiator opening 48 therein. The passive radiator 40 includes a radiator mass 41 and a radiator suspension 42 coupling the radiator mass within the radiator opening 48. The radiator mass 41 may be tungsten, and the radiator suspension 42 may include rubber and/or another relatively soft resilient material. The radiator mass 41 and the radiator suspension 42 may include other and/or additional materials. The mass 41 may in the form of a disc-shaped body.

The acoustic isolation between the speaker 31 and the passive radiator 40 is provided by a partition 35 within the housing 21 and outside the baffle enclosure 30 between the speaker and the passive radiator.

To generate haptic feedback, the passive radiator 40 may be tuned through inertia and internal acoustic pressure. The tuning may be selected such that the fundamental frequency of the desired haptic response is about equal to the tuning frequency of the passive radiator 40 for increased efficiency and reduced impact on audio performance. At the tuning frequency of the passive radiator 40, the speaker 31 generally has a low excursion resulting in relatively low distortion in the audio signals.

The passive radiator 40 vents acoustically into the housing 21, using the acoustic pressure to induce a distributed mechanical force on components inside the housing, for example, the display. The mechanical force results in a vibration event on the exterior of the product. For example, the vibration event may be a flexing of the glass, which in some embodiments is secured via an adhesive at the ends and sprung in the middle, anywhere between 5 and 10 microns.

During operation, the controller 22 may operate the speaker 31 at a relatively low frequency, for example, below 100 Hz. Operation below 100 Hz, for example, may be inefficient for the speaker 31 with respect to audibly hearing any sound, but operation at such a low frequency can be felt by a user, particularly when paired with the passive radiator 40 and configured as described above. Accordingly, by selectively operating the speaker 31, haptic feedback is provided through the display 23. In some embodiments, the haptic feedback may be in response to input via the display 23, when the display is in the form of a touch screen display. In other words, it may be desirable to set the operation frequency to a frequency equal to the resonance frequency of the passive radiator 40. A frequency of 100 Hz may be considered a reasonable frequency for the present embodiment.

A method aspect is directed to a method of making an electronic device 20 that includes a housing 21 having an audio output port 32 therein and a display 23 carried by the housing. The method includes mounting an audio output transducer 31 on a baffle enclosure 30 and mounting a passive radiator 40 on the baffle enclosure. The method also includes mounting the baffle enclosure 30 within the housing 21 so that the audio output transducer 31 is acoustically coupled to the audio output port 32 and so that the passive radiator 40 is acoustically coupled between the audio output transducer and the display 23, and acoustically isolated from the audio output port.

Figure 4:
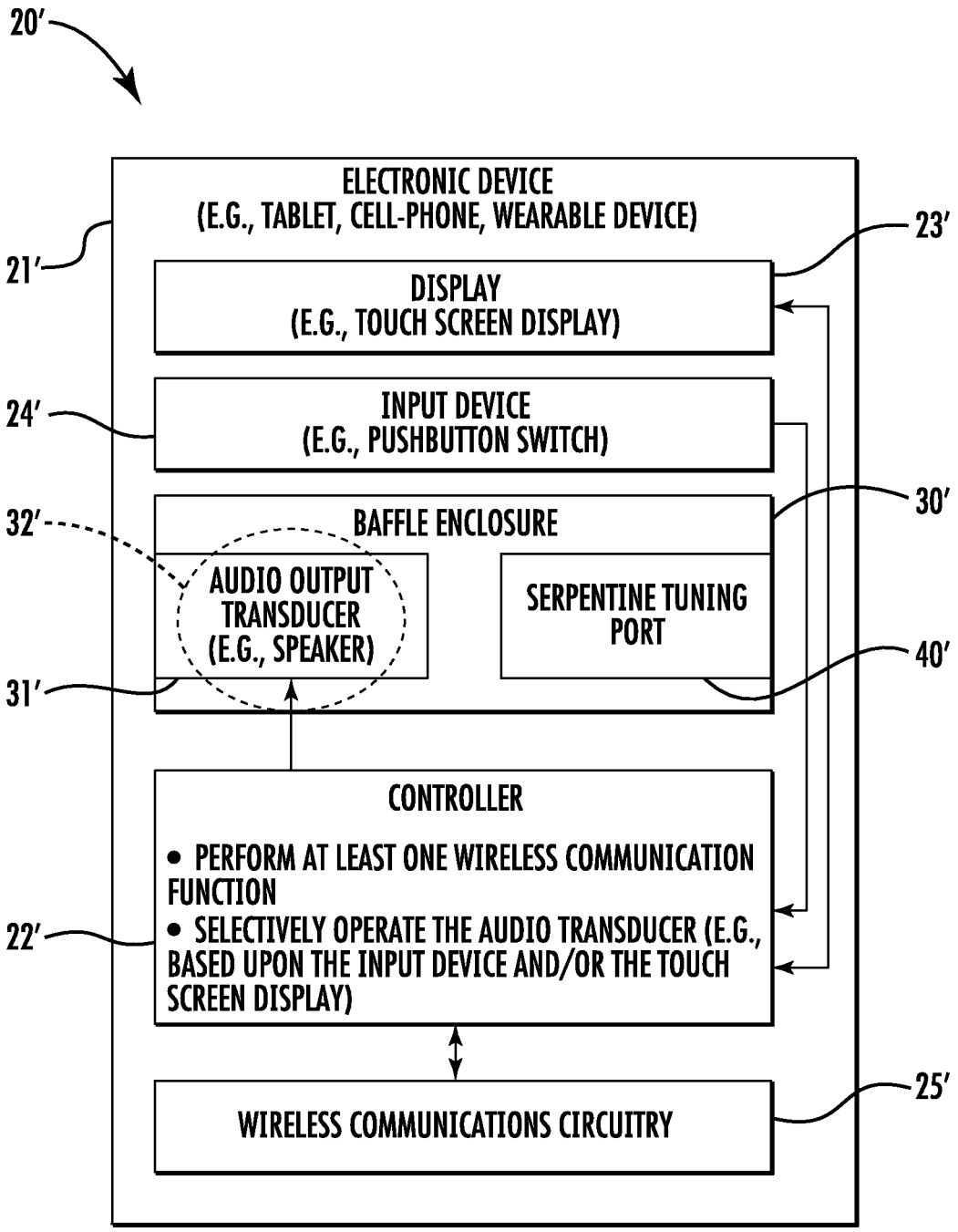
FIG. 4 is a schematic block diagram of the electronic device according to another embodiment.
Figure 5A:
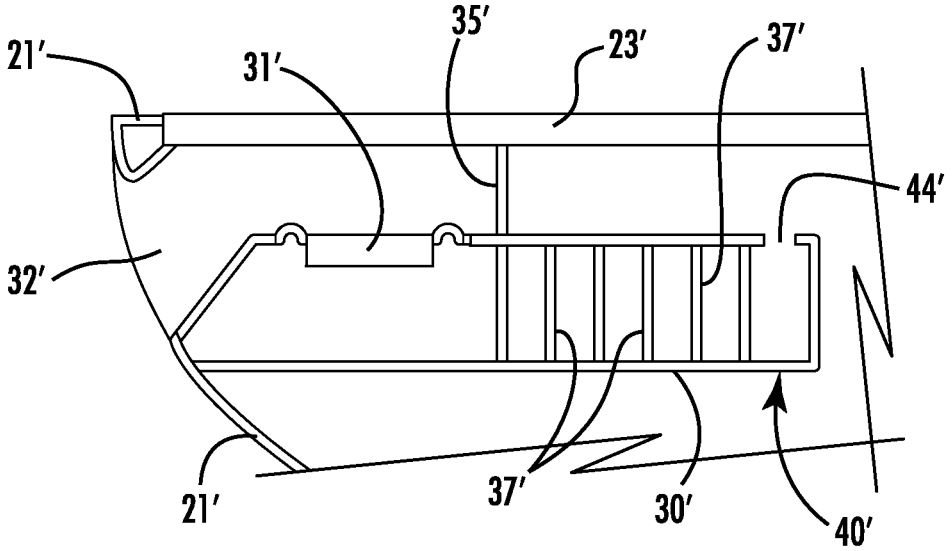
FIG. 5*a* is a schematic cross-sectional view of a portion of the electronic device of FIG. 4.
Figure 5B:
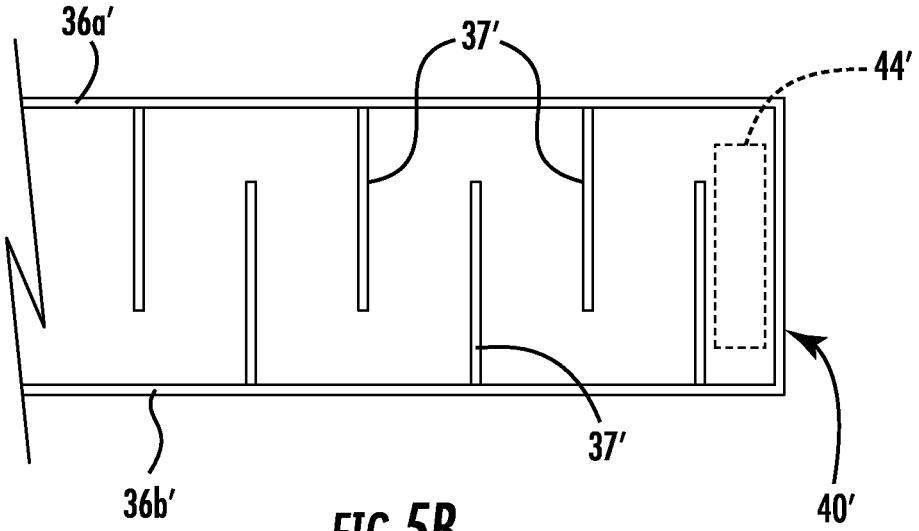
FIG. 5*b* is a schematic top view of the serpentine tuning port of FIG. 5*a*.

Referring now to FIGS. 4 and 5, in another embodiment, instead of a passive radiator, a plurality of internal partitions 37' are carried by the baffle enclosure 30' to define a serpentine tuning port 40' laterally adjacent the speaker 31'. In other embodiments, the serpentine port 40' and speaker 31' may not be laterally adjacent. The serpentine tuning port 40' is acoustically coupled to the display 23', and more particularly, between the speaker 31' and the display. The baffle enclosure 30' also has a tuning port opening 44' therein, and the serpentine tuning port 40' is directed to the underside of the display 23' to also provide the haptic feedback through the display. The serpentine tuning port 40' is also acoustically isolated from the audio output port 32'.

The baffle enclosure 30' has first and second opposing sidewalls **36*a*', 36*b*'. The internal partitions 37' illustratively are parallel and extend inwardly from the opposing first and second sidewalls 36*a*', 36*b*', in an alternating fashion. In other embodiments, the internal partitions 37'** may be configured differently, for example, to be tuned to a desired frequency for haptic feedback.

The serpentine tuning port 40' is tuned, for example, by shape, length, width, etc., as will be appreciated by those skilled in the art, for the desired operational frequency for haptic feedback.

Similar to the passive radiator described above, the acoustic isolation between the speaker 31' and the serpentine tuning port 40' is provided by a partition 35' within the housing 21' between the speaker and the serpentine tuning port. More particularly, the partition 35' extends transverse to the sidewall of the device housing 21' and a sidewall of the baffle enclosure 30'.

To generate haptic feedback, the serpentine tuning port 40' may be tuned as noted above, but unlike the passive radiator, there is not an inertial component. Similar to the passive radiator, the serpentine tuning port 40' vents acoustically into the housing 21', using the acoustic pressure to induce a distributed mechanical force on components inside the housing, for example, the display 23'. The mechanical force results in a vibration event on the exterior of the electronic device 20'. For example, the vibration event may be a flexing of the glass, which in some embodiments is secured via an adhesive at the ends and sprung in the middle, anywhere between 5 and 10 microns.

During operation, the controller 22' may operate the speaker 31' at a relatively low frequency, for example, below 100 Hz. Operation below 100 Hz, for example, may be inefficient for the speaker 31' with respect to audibly hearing any sound, but operation at such a low frequency can be felt by a user, particularly when paired with the serpentine tuning port 40' and configured as described above. Accordingly, by selectively operating the speaker 31', haptic feedback is provided through the display 23'. In some embodiments, the haptic feedback may be in response to input via the display 23', when the display is in the form of a touch screen display. In other words, it may be desirable to set the operation frequency to frequency equal to the resonance frequency of the serpentine tuning port 40' A frequency of 100 Hz may be considered a reasonable frequency for the present embodiment.

Additionally, the serpentine tuning port 40' may be cheaper, in terms of cost to manufacture and implement, than the passive resonator. For example, for larger displays, the mass on the passive radiator would have to be relatively large to induce the distributed mechanical force, which may become relatively costly. As will be appreciated by those skilled in the art, if there is a large enough cross-sectional area, a serpentine tuning port may be more advantageous than a passive radiator.

A method aspect is directed to a method of making an electronic device 20' that includes a housing 21' having an audio output port 32' therein and a display 23' carried by the housing. The method includes mounting an audio output transducer 31' on a baffle enclosure 30' and mounting a plurality of internal partitions 37' on the baffle enclosure to define a serpentine tuning port 40' therein. The method includes mounting the baffle enclosure 30' so that audio output transducer is acoustically coupled to the audio output port 32', and so that the serpentine tuning port 40' is acoustically coupled between the audio output transducer and the display and to be acoustically isolated from the audio output port.

Figure 6:
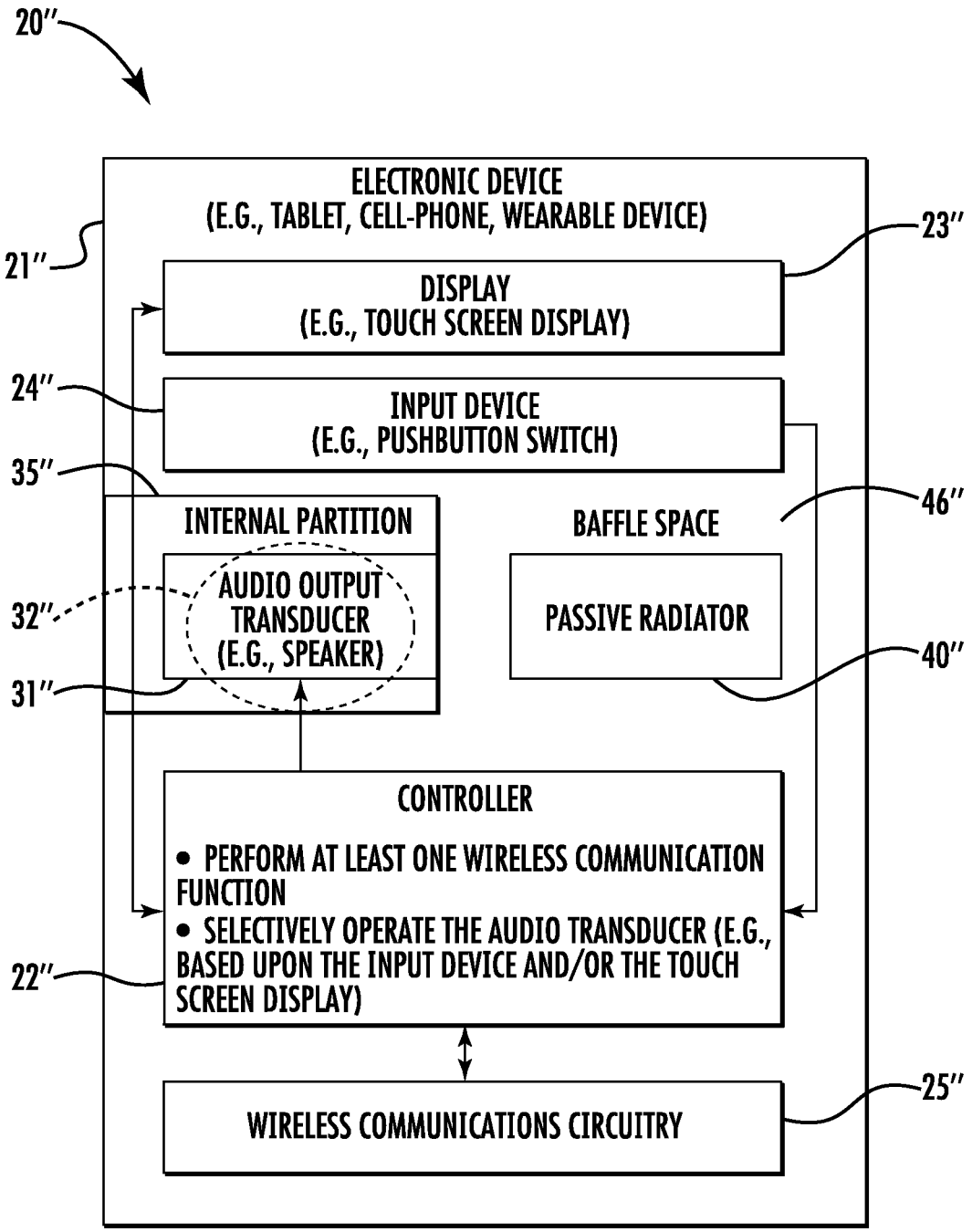
FIG. 6 is a schematic block diagram of the electronic device according to another embodiment.
Figure 7:
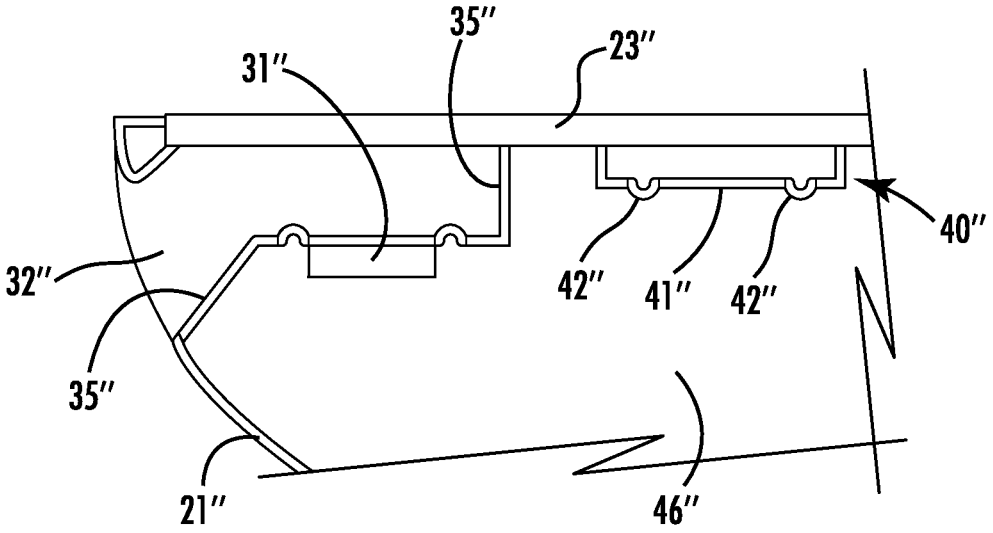
FIG. 7 is a schematic cross-sectional view of a portion of the electronic device of FIG. 6.

Referring now to FIGS. 6 and 7, in another embodiment, an internal partition 35" is illustratively carried within the housing 21". The internal partition 35" may divide the internal area of the device housing 21" between relatively small and large spaces, the larger space defining a baffle space 46". The baffle space 46" is behind the display 23". It should be noted that the baffle space 46" may be behind a portion of the display 23" or may be behind all of the display. In other words, the baffle space 46" may be a relatively large portion of the interior of the device housing 21" that carries circuitry, etc. and may be more than half of the interior area of the device housing.

An audio output transducer in the form of a miniature speaker 31" is carried by the internal partition 35" and is acoustically coupled to the audio output port 32". A passive radiator 40" is within the baffle space 46" and is acoustically coupled between the speaker 31" and the display 23". The passive radiator 40" is also acoustically isolated from the audio output port 32".

The passive radiator 40" is similar to that described above with respect to FIGS. 2 and 3, and includes a radiator baffle enclosure 30", which is carried within the baffle space 36", a radiator mass 41" and a radiator suspension 42". In other words, the passive radiator 40" is physically separated within the device housing 21" from the speaker 31".

The acoustic isolation between the speaker 31" and the passive radiator 40" is provided by the internal partition 35" within the housing 21" and outside the baffle enclosure 30" between the speaker and the passive radiator. More particularly, the passive radiator 40" is positioned within the device housing 21" so that the one side of the mass 41" is exposed to the acoustic flow, while another side of the mass is not. Using this arrangement, the passive radiator 40" may be located anywhere in the baffle space 46". More than one passive radiator 40" may be within the baffle space so long as the passive radiator is acoustically coupled between the speaker 31" and the display 23", and is acoustically isolated from the audio output port 32".

To generate haptic feedback, the passive radiator 40" may be tuned through inertia and internal acoustic pressure. It should be noted that the inertial component (i.e., reaction force) of the passive radiator 40" is in the opposite direction than the passive radiator described above with respect to the FIGS. 2 and 3. Thus, it may not be particularly desirable to position the passive radiator 40" adjacent a side of the housing 21" opposite the display, as haptic efficiency may be greatly reduced. Similar to the passive radiator described above, the passive radiator 40" vents acoustically into the housing 21", using the acoustic pressure to induce a distributed mechanical force on components inside the housing, for example, the display 23". The mechanical force results in a vibration event on the exterior of the product.

As will be appreciated by those skilled in the art, the volume of air V between the passive radiator 40" and the display 23" may be particularly important as it performs as an air spring, which in turn affects the resonance frequency of the passive radiator. Operation of the speaker 31" using the controller 22" is similar to the embodiments described above.

Figure 8:
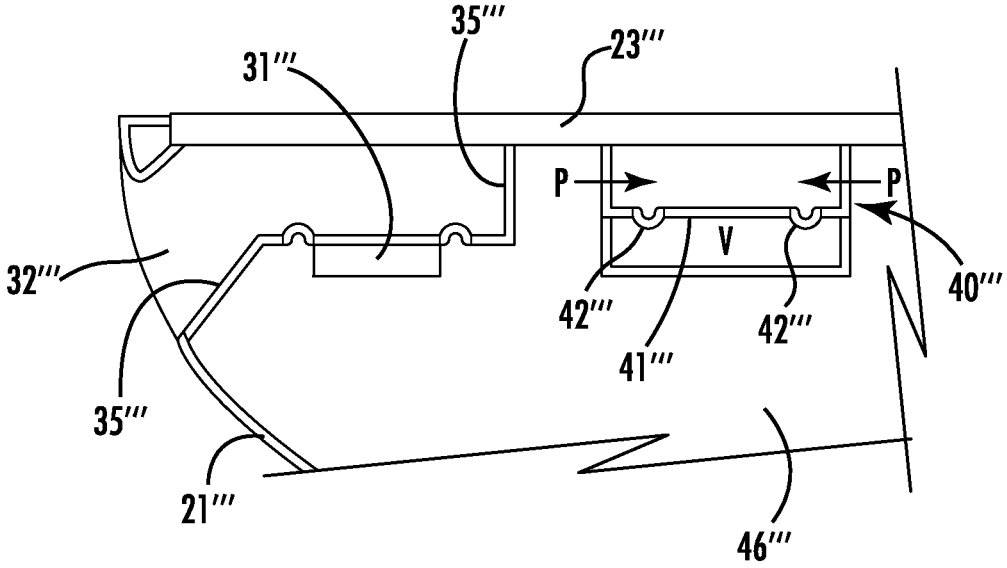
FIG. 8 is a schematic cross-sectional view of a portion of an electronic device according to another embodiment.

Referring now briefly to FIG. 8, in another embodiment similar to the embodiment described above with respect to FIGS. 6 and 7, the passive radiator 40''' is mounted to the underside of the display 23''' such that airflow is permitted between the radiator mass 41''' and the radiator suspension 42'''. In this arrangement, the actuation pressure P occurs on the side of the passive radiator 40''' facing the underside of the display 23''', with the passive radiator back volume V being in the space below.

A method aspect is directed to a method of making an electronic device 20" that includes a housing 21" having an audio output port 32" therein, and a display 23" carried by the housing. The method includes mounting an internal partition 35" within the housing 21" to define a baffle space 46" behind at least a portion of the display 23", mounting an audio output transducer 31" on the internal partition so that it is acoustically coupled to the audio output port 32", and mounting a passive radiator 40" within the baffle space so that it is acoustically coupled between the audio output transducer and the display and acoustically isolated from the audio output port.

Figure 9:
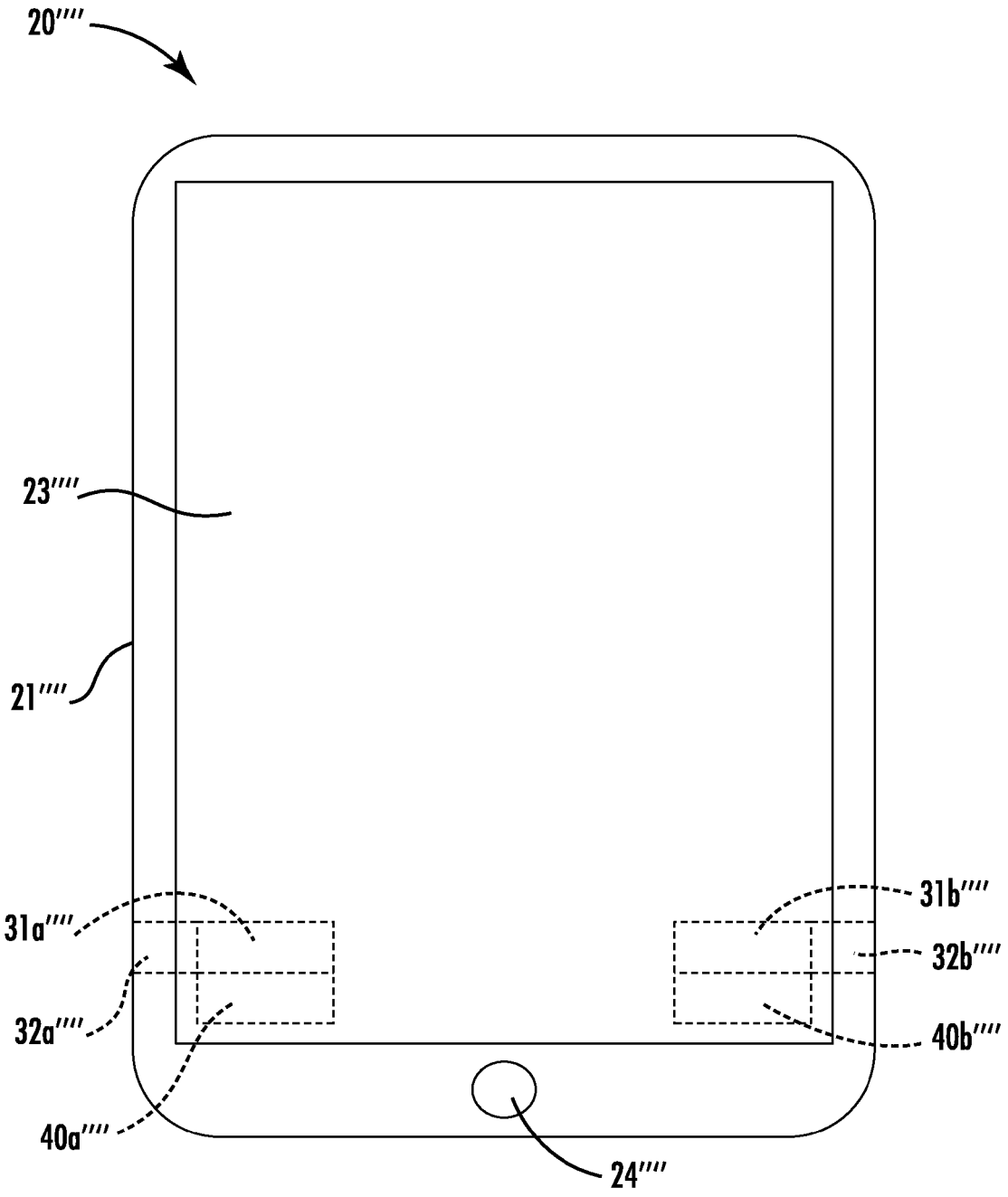
FIG. 9 is a top view schematically illustrating a portion of an electronic device according to another embodiment.

Referring to FIG. 9, in another embodiment of the electronic device 20"" there may be a plurality of audio output transducer and passive radiator pairs, and more specifically, for stereo operation, two pairs of audio output transducer and passive radiator pairs 31*a*"", 31*b*"", 40*a*"", 40*b*"" carried by the housing 21"". Each of the two pairs of audio output transducers and passive radiators 31*a*"", 31*b*"", 40*a*"", 40*b*"" has a respective baffle enclosure and is similar to the audio output transducer and passive radiator described above with respect to FIGS. 2 and 3. In particular, each audio output transducer 31*a*"", 31*b*"" is acoustically coupled to a respective audio output port 32*a*"", 32*b*"", and each and passive radiator 40*a*"", 40*b*"" is coupled between the paired audio output transducer and the display 23"" and acoustically isolated from the respective audio output port. The controller 22"" may selectively operate the plurality of audio output transducers 31*a*"", 31*b*"" to provide stereo sound, and may also provide localized or directed haptic feedback through the areas of the display adjacent the passive radiators 40*a*"", 40*b*"".

A method aspect is directed to a method of making an electronic device 20"" that includes a housing 21"" and a display 23"" carried by the housing. The method includes mounting a plurality of audio output transducer and passive radiator pairs 31*a*"", 31*b*"", 40*a*"", 40*b*"" carried by the housing 21"", and coupling a controller 22"" to selectively operate the plurality of audio output transducers.

Figure 10:
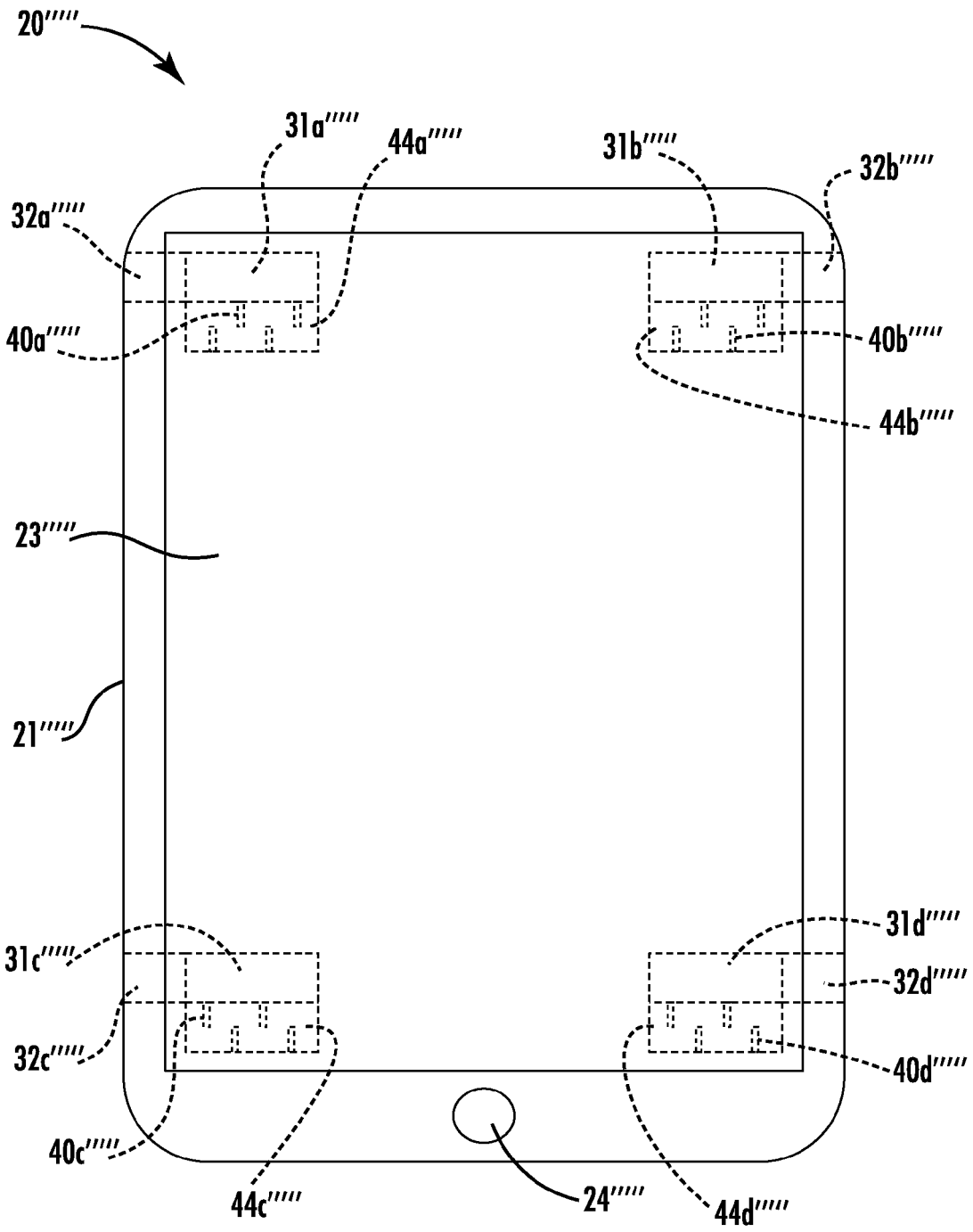
FIG. 10 is a top view schematically illustrating a portion of an electronic device according to another embodiment.

Referring to FIG. 10, in another embodiment of the electronic device 20""" there may be a plurality of audio output transducer and serpentine tuning port pairs, and more specifically, for quadraphonic operation, four pairs of audio output transducer and serpentine tuning port pairs 31*a*""-31*d*"", 40*a*""-40*d*"" carried by the housing 21""". Each of the four pairs of audio output transducers and passive radiators 31*a*""-31*d*"", 40*a*""-40*d*"" has a respective baffle enclosure and is similar to the audio output transducer and serpentine tuning port described above with respect to FIGS. 4, 5*a*, and 5*b*. In particular, each audio output transducer 31*a*""-31*d*"" is acoustically coupled to a respective audio output port 32*a*""-32*d*"", and each serpentine tuning port 40*a*""-40*d*"" is coupled between the paired audio output transducer and the display 23""" and acoustically isolated from the respective audio output port. The controller 22""" may selectively operate the plurality of audio output transducers 31*a*""-31*d*"" to provide quadraphonic sound, and may also provide localized or directed haptic feedback through the areas of the display 23""" adjacent the passive radiators 40*a*"", 40*d*"", for example, the four corners of the display.

A method aspect is directed to a method of making electronic device 20""" that includes a housing 21""" and a display 23""" carried by the housing. The method includes mounting a plurality of audio output transducer and serpentine tuning port pairs 31*a*""-31*d*"", 40*a*""-40*d*"" on the housing 21""", and coupling a controller 22""" to selectively operate the plurality of audio output transducers.

While two and four pairs of audio output transducer and passive radiator/serpentine tuning port pairs have been described, it will be appreciated by those skilled in the art that the there may be any number of audio output transducer and passive radiator or serpentine tuning port pairs. Moreover, in some embodiments, at least one pair may be an audio output transducer and passive radiator pair while at least one other pair may be an audio output transducer and serpentine tuning port pair. In other words, the plurality of pair may be mixed between audio output transducer and passive radiators pairs and audio output and serpentine tuning port pairs.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. An electronic device comprising:

a housing having an audio output port therein;

a display carried by the housing;

a baffle enclosure carried within the housing;

an audio output transducer carried by the baffle enclosure and acoustically coupled to the audio output port, the audio output transducer being positioned relative to the display to provide haptic feedback through the display; and a plurality of internal partitions carried by the baffle enclosure to define a serpentine tuning port therein acoustically coupled between the audio output transducer and the display, and acoustically isolated from the audio output port to also provide the haptic feedback through the display.

2. The electronic device of claim 1 wherein the audio output transducer is directed to an underside of the display.

3. The electronic device of claim 1 wherein the baffle enclosure has a tuning port opening therein.

4. The electronic device of claim 3 wherein the tuning port opening is directed to an underside of the display.

5. The electronic device of claim 4 wherein the audio output transducer is laterally adjacent the tuning port opening.

6. The electronic device of claim 5 further comprising an external partition carried within the housing and outside the baffle enclosure between the audio output transducer and the tuning port opening.

7. The electronic device of claim 1 wherein the baffle enclosure comprises opposing first and second sidewalls; and wherein the plurality of internal partitions extend inwardly from the opposing first and second sidewalls.

8. The electronic device of claim 7 wherein the plurality of internal partitions extend inwardly from the opposing first and second sidewalls in an alternating fashion.

9. The electronic device of claim 1 wherein the plurality of internal partitions are parallel.

10. The electronic device of claim 1 wherein the display comprises a touch-screen display.

11. An electronic device comprising:

a housing having an audio output port therein;

wireless communications circuitry carried by the housing;

a display carried by the housing;

a baffle enclosure carried within the housing;

an audio output transducer carried by the baffle enclosure and acoustically coupled to the audio output port, the audio output transducer being positioned relative to the display to provide haptic feedback through the display;

a plurality of internal partitions carried by the baffle enclosure to define a serpentine tuning port therein acoustically coupled between the audio output transducer and the display, and acoustically isolated from the audio output port to also provide the haptic feedback through the display; and a controller coupled to the wireless communications circuitry, the display, and the audio output transducer, the controller configured to perform at least one wireless communications function, and selectively operate the audio output transducer to provide the haptic feedback through the display.

12. The electronic device of claim 11 wherein the audio output transducer is directed to an underside of the display.

13. The electronic device of claim 11 wherein the baffle enclosure has a tuning port opening therein.

14. The electronic device of claim 13 wherein the tuning port opening is directed to an underside of the display.

15. The electronic device of claim 14 wherein the audio output transducer is laterally adjacent the tuning port opening.

16. The electronic device of claim 15 further comprising an external partition carried within the housing and outside the baffle enclosure between the audio output transducer and the tuning port opening.

17. A method of making an electronic device comprising a housing having an audio output port therein, and a display carried by the housing, the method comprising:

mounting an audio output transducer on a baffle enclosure;

mounting a plurality of internal partitions to be carried by the baffle enclosure to define a serpentine tuning port therein; and mounting the baffle enclosure within the housing so that the audio output transducer is acoustically coupled to the audio output port and positioned relative to the display to provide haptic feedback through the display, and so that the serpentine tuning port is between the audio output transducer and the display and acoustically isolated from the audio output port to also provide the haptic feedback through the display.

18. The method of claim 17 wherein mounting the baffle enclosure comprises mounting the baffle enclosure to be directed to an underside of the display.

19. The method of claim 17 wherein mounting the baffle enclosure comprises mounting the baffle enclosure so that a tuning port opening therein is directed to an underside of the display.

20. The method of claim 17 wherein mounting the baffle enclosure comprises mounting a baffle enclosure comprising opposing first and second sidewalls; and wherein the plurality of internal partitions extend inwardly from the opposing first and second sidewalls.

* * * * *